US005830838A

United States Patent [19]

Wurzburger et al.

[11] Patent Number: 5,830,838

[45] Date of Patent: Nov. 3, 1998

[54] ACID REPLACEMENT SOLUTION FOR CLEANING NON FERROUS METALS

[76] Inventors: Stephen R. Wurzburger, P.O. Box C, Goodyear Bar, Calif. 95944; James M. Overton, 1127 Nickel Ln., Yuba City, Calif. 95911

[21] Appl. No.: 701,776

[22] Filed: Aug. 26, 1996

[51] Int. Cl.[6] ..... C11D 7/06; C11D 7/08

[52] U.S. Cl. ..... 510/254; 510/269; 510/272; 510/531; 134/2; 134/3; 134/28; 134/29; 134/41

[58] Field of Search ..... 134/2, 3, 28, 29, 134/41; 510/254, 269, 272, 531

[56] References Cited

U.S. PATENT DOCUMENTS 3,625,908 12/1971 Magin ..... 252/142

5,683,725 11/1997 Malik et al. ..... 424/196

*Primary Examiner*—Douglas J. McGinty

*Assistant Examiner*—Gregory R. DelCotto

*Attorney, Agent, or Firm*—Robert Samuel Smith

[57] ABSTRACT

A solution for cleaning metal surfaces particularly non ferrous alloys such as copper, brass and high strength aluminum alloys. The solution is prepared by mixing $Ca(OH)_2$ and KOH with equivalent sulfuric acid in water then passing the solution through a 10 micron filter. The resulting concentrate can be used full strength or diluted depending on the degree of surface oxidation of the metal to be treated.

2 Claims, 1 Drawing Sheet

ADD $H_2SO_4$ TO WATER

MIX $Ca(OH)_2$ AND KOH IN WATER

MIX THE TWO SOLUTIONS

FILTER

FIG. 1

ACID REPLACEMENT SOLUTION FOR CLEANING NON FERROUS METALS

FIELD OF THE INVENTION

This invention relates to cleaning metals and particularly to an aqueous solution containing a high concentration of hydrogen ions for cleaning non ferrous- metals.

Prior Art and Information Disclosure

The job of cleaning non-ferrous metals such as a copper, brass and aluminum presents problems not found in cleaning ferrous materials. Not only must the surfaces be clean but the surface must be free of oxides and surface chemical contamination that would hinder soldering or brazing and be as environmentally safe as possible.

Most of the common standard cleaning agents and fluxes are moderate to strong acid and, upon heating, emit noxious vapors. Such agents left on the surface of the metal present a danger to human contact.

Fumes from these acid cleaning solutions present another hazard to health in the work place that must be dealt with.

Various efforts have been directed toward the use of stabilizing agents that hold benign abrasive particles in suspension and rely on mechanical agitation for removal of surface oxidation.

SUMMARY

In view of the problems of cleaning non-ferrous metals in preparation for soldering and brazing, it is therefore an object of this invention to provide an aqueous solution with a pH sufficiently high to remove stubborn oxide layers without leaving a metal residue on the metal surface.

It is another object of this invention to provide a cleaning solution that poses a minimal hazard to the environment.

This invention is directed toward a method for preparing an aqueous cleaning solution including the addition of concentrated sulfuric acid to a solution of hydrated lime and concentrated potassium hydroxide in water. Sufficient $H_2SO_4$ is added to precipitate the calcium and potassium ions as $CaSO_4$ and $K_2SO_4$ and leave a solution with a pH less than 1. The resulting mixture in solution is put through a 10 micron filter to remove any particles of calcium or potassium sulfate larger than 11 microns. The filtrate has a very low pH

BRIEF DESCRIPTION OF THE FIGURE

FIG. 1 is a flow chart of the method of the invention.

DESCRIPTION OF A PREFERRED EMBODIMENT

Turning now to a discussion of FIG. 1, there is shown a flow chart of the steps in one embodiment of the invention for preparing the acid replacement solution (cleaning solution) of this invention.

Step 1: Two moles of concentrated $H_2SO_4$ (93%) are added to 2 liters of deionized water.

Step 2: One mole of $Ca(OH)_2$ (hydrated lime) and two moles of KOH is added to 2 liters of deionized water and stirred.

Step 3: The concentrated acid solution of step 1 is slowly added to the solution of step 2. The mixture is stirred until the reaction is complete.

Step 4: the mixture is passed through a 10 micron filter thereby removing particles of $CaSO_4$ or $K_2SO_4$ eleven microns or larger.

If the metal surface to be cleaned is heavily oxidized, the solution should be used at full strength.

If the metal surface to be cleaned is lightly oxidized, then the solution may be diluted to 50% strength.

The method of treatment also depends on circumstances. For example, copper parts that have a heavy oxide coating may be placed in the solution until the coating is dissolved. Then the part is rinsed in water. For parts that have a very light coat, wiping with a rag dipped in a 50% solution is adequate for removing the oxide layer.

This solution concentrate has many applications as a replacement for strong acids in non-ferrous cleaning operations.

This invention offers a number of important features.

One advantage is that, even though the pH is high, it has little or no corrosive effect on flesh.

Another advantage is that, if the solution is exposed to air for a moderate period of time (about 45 mins.) the solution deactivates to where it is readily disposable in the environment. If solution is stored in a sealed container, the solution will remain active for long periods of time.

The solution does not emit vapors such as are emitted by cleaners used in current cleaning process, which vapors are hazadous to the health of the workers.

Another advantage is that there is no film left on the metal surface.

Another advantage is that its use requires only minimal storage and handling cost as it deactivates and leaves no undesirable acid residue.

Variations and modification of this invention may be suggested by reading the specification which are within the scope of the invention.

For example, NaOH may be used in place of KOH in the solution but KOH is preferred particularly in situations where rinse water residues are an important concern.

$CaO*H_2O$ may be used in place of $Ca(OH)_2$ but longer digestion time is required.

In view of such variations and modifications, we therefore wish to define the scope of our invention by the appended claims.

We claim:

1. A cleaning solution for use on copper alloys which consists of a first solution of one of:

(i) one half mole of $Ca(OH)_2$ and one mole of KOH;

(ii) one half mole of CaO and one mole of KOH (iii) one half mole of Calcium metal;

reacted with about one half mole of $H_2SO_4$ in a quantity of water, said quantity selected from a range between one half liter and one liter, and filtered to remove precipitates of $CaSO_4$ and $K_2SO_4$ larger than 10 microns whereby a cleaning solution is provided for cleaning copper alloys.

2. A method for preparing the cleaning solution of claim 1 which includes the steps in operable order:

(a) producing a first solution by adding two moles of concentrated $H_2SO_4$ (93%) to 2 liters of deionized water;

(b) producing a second solution by adding one mole of one of:
(i) $Ca(OH)_2$;
(ii) $CaO*H_2O$; and
two moles of KOH to 2 liters of deionized water; and (c) stirring said second solution;

(d) adding said first solution to said second solution;

(e) stirring said first solution added to said second solution until reaction of said first solution with said second solution is complete whereby a third solution is produced;

(f) passing said third solution through a 10 micron filter whereby particles of $CaSO_4$ and $K_2SO_4$ are removed that are larger than ten microns.

* * * * *